United States Patent [19]

Rohner et al.

[11] 4,445,319

[45] May 1, 1984

[54] DEVICE FOR TYING A FIRST THREAD TO A SECOND THREAD BY SPLICING WITH PRESSURE GAS

[75] Inventors: Joachim Rohner; Heinz Zumfeld, both of Mönchen-Gladbach, Fed. Rep. of Germany

[73] Assignee: W. Schlafhorst & Co., Mönchengladbach, Fed. Rep. of Germany

[21] Appl. No.: 409,424

[22] Filed: Aug. 19, 1982

[30] Foreign Application Priority Data

Aug. 20, 1981 [DE] Fed. Rep. of Germany ..... 3132894

[51] Int. Cl.[3] ..... D01H 15/00

[52] U.S. Cl. ..... 57/22; 57/261

[58] Field of Search ..... 57/22, 23, 261, 263; 242/35.6

[56] References Cited

U.S. PATENT DOCUMENTS

| | | | |
|---|---|---|---|
| 4,217,749 | 8/1980 | Rohner et al. | 57/22 X |
| 4,232,509 | 11/1980 | Rohner et al. | 57/22 X |
| 4,240,247 | 12/1980 | Matsui et al. | 57/22 X |
| 4,263,775 | 4/1981 | Mima | 57/22 |
| 4,344,277 | 8/1982 | Rohner et al. | 57/22 |

*Primary Examiner*—Donald Watkins

*Attorney, Agent, or Firm*—Herbert L. Lerner; Laurence A. Greenberg

[57] ABSTRACT

Device for tying a first thread to a second thread by splicing with pressure gas, the device having a splicing chamber formed with an elongated slot for inserting and tying the threads, at least one pressure-gas channel terminating in an interior space of the splicing chamber, a thread regulator movable from a thread take-up position to a thread delivery position for laying the thread into the elongated slot of the splicing chamber, and controllable parts including thread severing devices for separating ends of the threads, a controllable and adjustable pressure-gas dosing device connected to the pressure-gas channel, a device disposed above the splicing chamber for taking up the thread end of the second thread, a device disposed below the splicing chamber for taking up the thread end of the first thread, a controllable thread gripper for the first thread, and a controllable thread gripper for the second thread, including an opening device in the thread gripper of the second thread, and the pressure-gas channel terminating eccentrically in the interior space of the splicing chamber for forming a vortex.

3 Claims, 2 Drawing Figures

14 to the device 11 at the winding station. The first thread 12 likewise reaches the device 11 from a take-up or winding coil 15.

Figure 1:
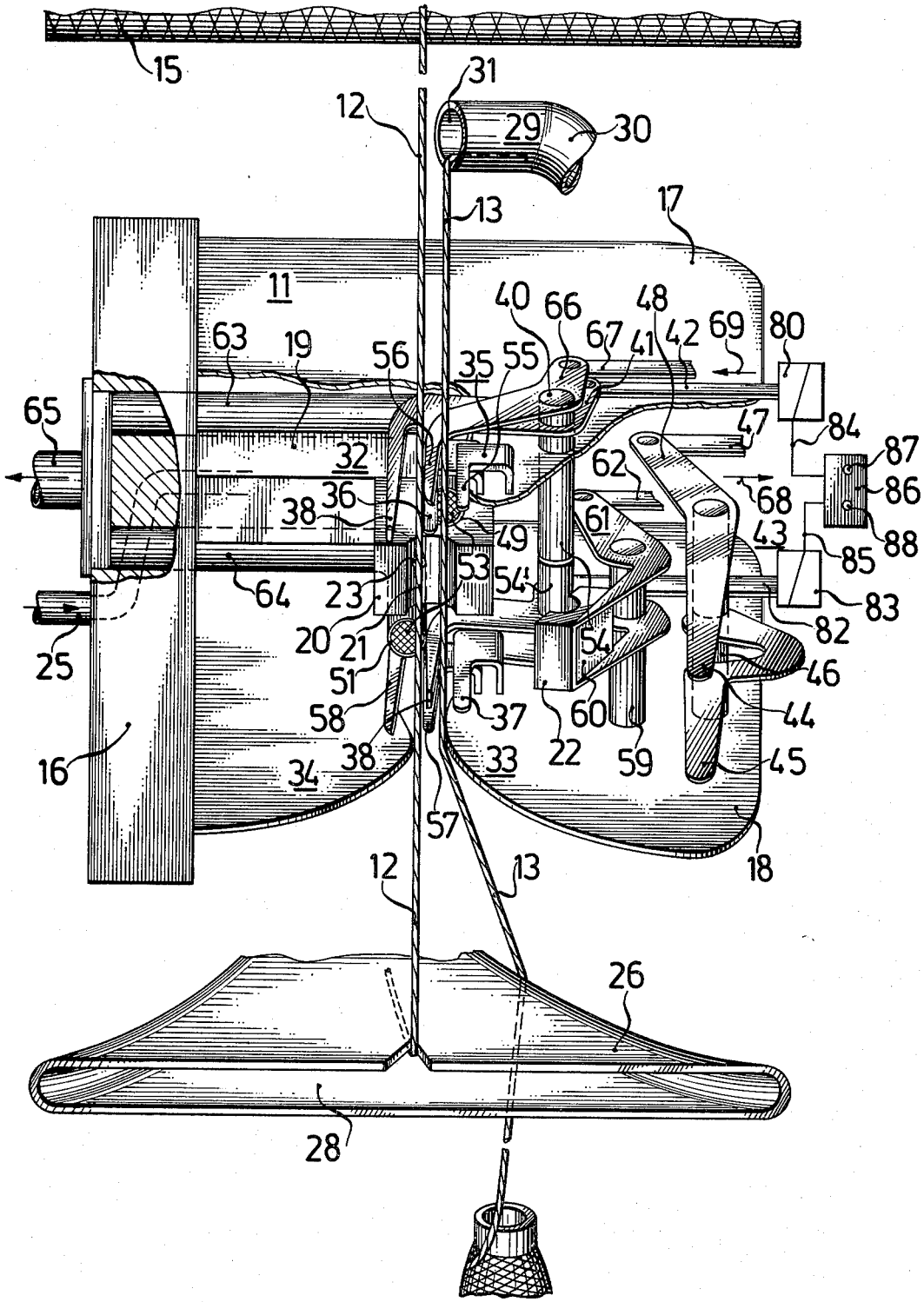

The device 11 has two plates 17 and 18 fastened to the machine frame 16. A splicing chamber 20 is fastened to an arm or bracket 19 of the machine frame 16. The splicing chamber 20 is formed with an elongated slot 21 which may be closed by a cover 22. When the cover 22 is opened, the threads can be inserted and laid into the elongated slot 21 of the splicing chamber 20. A pressure-gas channel 23 terminates eccentrically in the interior space of the splicing chamber 20 formed by the elongated slot 21 and the cover 22. The pressure-gas channel 23 is connected to a pressure-gas channel 24 provided in the arm 19 and continues to a pipeline 25 leading to an otherwise nonillustrated pressure-gas dosing or metering device. A thread takeup device 26 is provided with means for seeking-out and holding-fast the thread end of the first thread 12 extending from the winding or take-up coil 15. These means are of conventional construction and formed of an otherwise non-illustrated inner hollow arm which is connected through the intermediary of a likewise non-illustrated swivel joint to an also non-illustrated vacuum source as well as to a suction slit nozzle 28. FIG. 1 shows the thread take-up device 26 with the thread 12 taken-up or seized thereby.

A pivotal gripper 29 is provided with means for seeking-out and holding fast the thread end of the lower thread 13. These means are formed of a curved tube 30 turnable in a swivel joint and having a suction nozzle 31 which can be closed by a non-illustrated conventional clamping cover subjected to spring force. The gripper 29 is shown in FIG. 1 with the taken-up thread 13. To take up the thread end of the lower thread 13, the tube 30 swivels downwardly, seizes or takes up the lower thread 13 in the vicinity of the supply coil 14, sucks it in through the suction nozzle 31, swivels back into the position shown in FIG. 1 and holds the thread end tight.

The figures of the drawing also illustrate two controllable thread grippers 32 and 33. The thread gripper 32 for the first thread 12 is disposed above the splicing chamber 20 and also above the plate 17, while the thread gripper 33 for the second thread 13 is disposed below the splicing chamber 20 and above the plate 18. Each of the two thread grippers 32 and 33 is of bipartite construction. The thread gripper 32 has a stationary gripper member 36 and a controllable gripper member 38 which is fastened to a hollow shaft 54 and has a lever 41 controllable by means of a rod 42 through an electromagnetic drive 80 serving as an opening and closing device. The thread gripper 33 for the second thread 13 has a stationary gripper member 37 and a controllable gripper member 38 which is connected to a hollow shaft 54' and has a level 81 connected by means of a rod 82 to an electromagnetic drive 83 serving as an opening and closing device. The hollow shafts 54 and 54' are journalled in the plates 17 and 18. The gripper member 36 is connected to the plate 17, and the gripper member 37 to the plate 18.

The figures of the drawing, furthermore, show a pivotal, double-armed thread regulator 43 formed of a bolt or pin 46 with regulator elements 44 and 45 fastened thereto. The pin 46 is turnably supported in the plates 17 and 18. To swivel the thread regulator 43, a rod 47 is movably connected to a lever 48 fastened to the regulator element 44.

The thread regulator 43 can be swung from the thread take-up position represented in FIG. 1. into an otherwise non-illustrated thread delivery position.

Above the splicing chamber 20, there is disposed a pneumatic device 49 for taking up the shortened thread end of the thread 13, and below the splicing chamber 20, a pneumatic device 51 for taking up the shortened thread end of the thread 12. Each of the two pneumatic devices 49 and 51 has a suction nozzle provided with a sieve-like perforated surface formed by a sieve-like screen of metal. The instant the thread ends are sucked in by the pneumatic devices 49 and 51, they remain adhered to the sieve-like perforated surface of the suction nozzle, without penetrating into the suction nozzle.

Above the upper regulator element 44, there is disposed a controllable severing device 35 for the thread 13, and below the lower regulator element 45, a controllable severing device 34 for the thread 12. Each severing device 34 and 35 is formed of two scissorlike cooperating knives or blades. One of the knives is respectively stationary, and the other is connected to a shaft 40 which is turnably supported in the hollow shaft 54. The knife 55 of the severing device 35 is fastened, for example, to the plate 17, while the knife 56 of the same severing device 35 is pivotally supported. The knife 57 of the severing device 34 is connected to the plate 18 while the knife 58 of the same severing device 34 is pivotally supported. A lever 66 connected to the knife 56 is articulatingly connected to a rod 67. The rod 67 is movable by a conventional, non-illustrated movable cam disk.

A shaft supported in the plates 17 and 18 carries a forked swivel arm 60 to which the cover 22 of the splicing chamber 20 is fastened. The swivel arm 60 has, at a rear end thereof, a lever 61 which is articulatingly connected to a rod 62.

It is apparent from the figures of the drawing that several parts of the device 11 according to the invention have special thread guide contours. This is the case, for example, with the thread takeup device 26 and with the plates 17 and 18, so that the threads 12 and 13 are laid into the splicing chamber in the manner shown in FIG. 1.

The pneumatic device 49 has a suction line 63, and the pneumatic device 51 a suction line 64. Both suction lines 63 and 64 terminate in a collecting line or manifold 65. The collecting line 65 extends to an otherwise non-illustrated suction-air dosing or metering element.

The electromagnetic drive 80 and the electromagnetic drive 83 are, respectively, connected by lines 84 and 85 to a switching mechanism 86 having two selector switches 87 and 88. A temporal priority or precedence is imparted to the opening device 80 by actuating the selector switch 87 and to the opening device 83 by actuation of the selector switch 88, as the case may be, over the respective other opening device.

Following is an explanation of the function and operation of the device according to the invention as considered in light of the figures of the drawing:

It is initially assumed that the thread to be rewound is broken at the winding station under consideration. Thereby, a thread 12 coming from above, and a thread 13 coming from below have been formed. The thread 12 has been taken up by the take-up or winding coil 15, and the thread 13 is held fast in the vicinity of the creel bobbin or supply coil 15. The selector switch 87 has been actuated.

DEVICE FOR TYING A FIRST THREAD TO A SECOND THREAD BY SPLICING WITH PRESSURE GAS

The invention relates to a device for trying a first thread to a second thread by splicing with pressure gas and, more particularly, to such a device formed of a splicing chamber with an optionally coverable elongated slot for inserting and tying the threads, one or more pressure-gas channels terminating in the interior space of the splicing chamber, a thread regulator movable from a thread take-up position to a thread delivery position for laying the thread into the elongated slot of the splicing chamber, and the following controllable parts:

(a) optionally a cover for transitorily locking the splicing chamber,
(b) thread covering devices for detaching the thread ends,
(c) a controllable and adjustable pressure-gas dosing device,
(d) a device disposed above the splicing chamber for taking up the thread end of the second thread,
(e) a device disposed below the splicing chamber for taking up the thread end of the first thread,
(f) a controllable thread gripper for the first thread, and
(g) a controllable thread gripper for the second thread.

When splicing short-staple yarn with pressure gas, it has been determined that, for producing a firm, end-free tie, a given thread twist or torsion must be given into the splicing location.

With conventional compressed-air splicing device a good splicing connection or tie is not readily producible with short-staple yarn. It is accordingly an object of the invention to provide a device for tying a first thread with a second thread by splicing with pressure gas, which will afford the production of good, firm and pleasingly appearing splicing connections or ties even with shortstaple yarn, and especially with thin threads.

With the foregoing and other objects in view there is provided, in accordance with the invention, a device of the foregoing general type for tying a first thread with a second thread by splicing with pressure gas, comprising an opening device in a thread gripper of the first thread, the opening device having a temporal priority over a second opening device in a thread gripper of the second thread, and the pressure-gas dosing device including at least one pressure-gas channel terminating eccentrically in the interior space of the splicing chamber for forming a vortex.

In a splicing process, usually threads of the same twist i.e. either threads with a Z-twist or threads with an S-twist, are connected or tied to one another. A pressure-gas vortext products the result, during the splicing operation, that the twist of the one thread becomes softer or less, whereas that of the other thread becomes harder or greater, in the region between the splicing chamber and the thread gripper. The fibers turbulently intermix and a splicing location develops. If the effect of the pressure gas on the splicing location then ceases, whether due to shutting off the supply of pressure gas or to the removal of the covering of the splicing chamber, then, with the thread grippers remaining yet closed, the twist travels back from the harder or more tightly twisted thread length into the splicing location and, moreover, into the softer or more weakly twisted thread length. This travelling-over of the thread twist is non-uniform, however, and also insufficient. The thread length having the twist which had been diminished does not get back as much thread twist as it had previously lost. It has been determined that, after the splicing operation, in the absence of adequate thread twist, a weakness or weak location remains in the thread or in the splicing location. Only one feature of the invention, namely that the thread gripper of the first thread, when opening, receives a temporal priority over the thread gripper of the second thread, affords relief here.

Then, after the splicing operation, the thread gripper of the more weakly twisted thread length is opened first. Thread twist accordingly travels both from outside the thread gripper as well as from the more tightly twisted thread length into the splicing location and into the more weakly twisted thread length. Then only is the other thread gripper opened and the thread entirely set free. If it should then again be subjected to tension, it is protected against being pulled apart and thread breakage due to the strengthened or reinforced twist. If the thread grippers, on the other hand, are simultaneously opened, the result is not as good.

Tests have established that it here primarily depends upon the staggered opening of the thread grippers, in contrast with simultaneous opening of the thread grippers, which is always disadvantageous when compared with a staggered opening, quite regardless of the particular sequence of the latter.

Other features which are considered as characteristic for the invention are set forth in the appended claims.

Although the invention is illustrated and described herein as embodied in a device for tying a first thread to a second thread by splicing with pressure gas, it is nevertheless not intended to be limited to the details shown, since various modifications and structural changes may be made therein without departing from the spirit of the invention and within the scope and range of equivalents of the claims.

Figure 2:
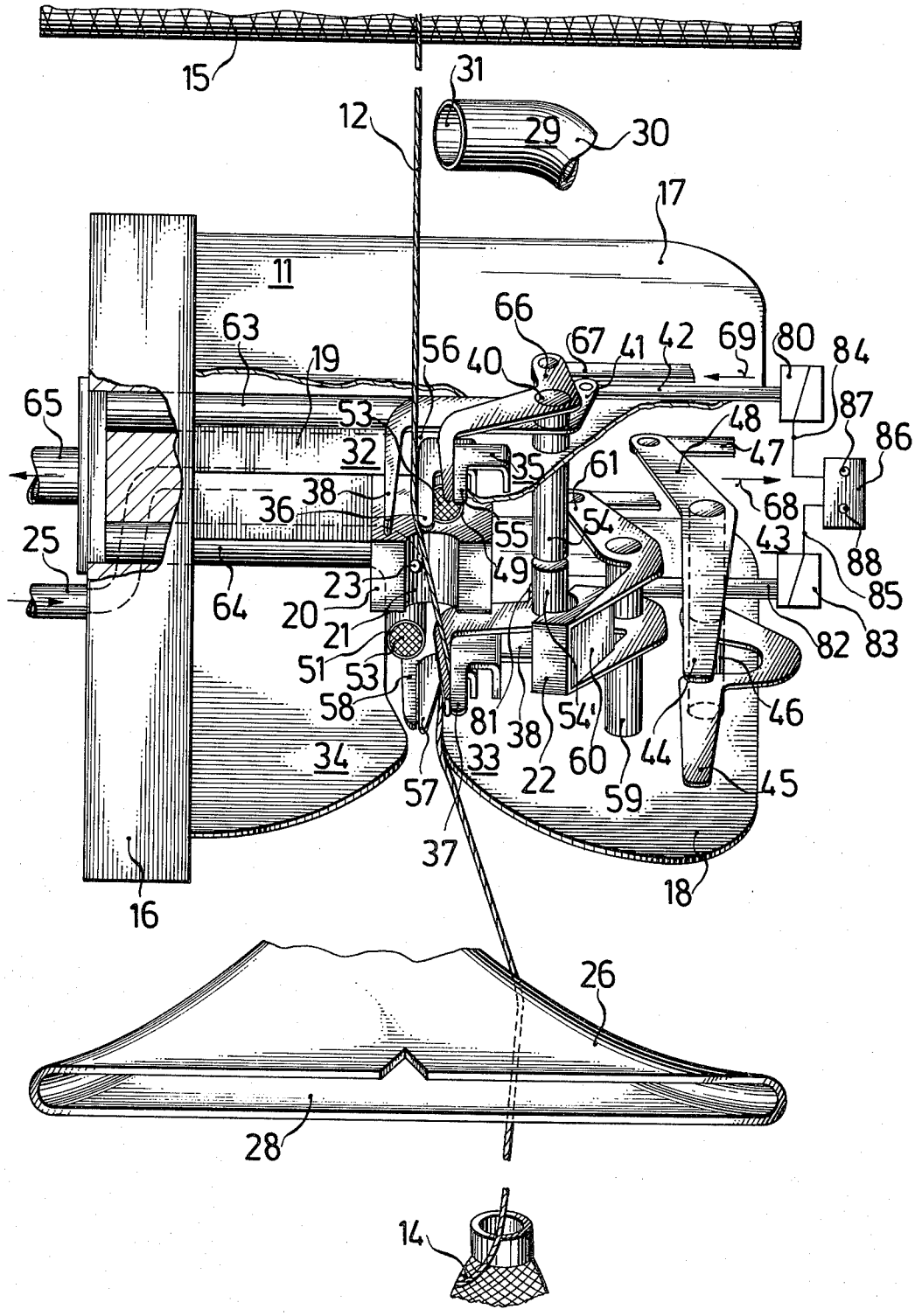

The construction and method of operation of the invention, however, together with additional objects and advantages thereof will be best understood from the following description of specific embodiments when read in connection with the accompanying drawings, in which:

FIG. 1 is a perspective view, partly diagrammatic, of the tying device according to the invention, in a stage of operation thereof wherein the splicing chamber is open and prior to commencement of the splicing operation; and FIG. 2 is the same view as that of FIG. 1 but showing the device in another stage of operation thereof subsequent to the splicing operation, with the thread gripper of the second thread length yet closed.

Referring now to FIGS. 1 and 2 of the drawing, there is shown the device according to the invention, identified as a whole by reference numeral 11, for tying a first thread 12 to a second thread 13. The device 11 has a machine frame 16 with an otherwise nonillustrated, conventional travelling frame or carriage provided with travel rollers with the aid of which the device 11 is able to travel on a supporting pipe along a textile machine, such as a winding frame, for example.

It is presupposed herein, merely for descriptive purposes, that the device 11 according to the invention is actually employed at a winding station. The second thread 13 is delivered from a creel bobbin or supply coil The break in the thread is determined in a conventional manner by non-illustrated means and the travelling device 11 has been informed thereof. The device 11 is driven in front of the winding station. The thread regulator 43 is shown in FIG. 1 in the thread take-up position thereof. The illustrated threads should initially be considered as not being present. The device 11 then operates in the following manner.

In the device 11, there is an otherwise not further illustrated control transmission or gear system provided with cam disks which starts up automatically in response to a signal caused by the winding station and swings the thread take-up device 26 so that the suction slit nozzle 28 is located close to the surface of the wind-up coil 15. Due to the vacuum acting at the suction slit nozzle 28, the thread end of the thread 12 is sought out, sucked in and held fast, with the wind-up coil 15 rotating slowly and running out, respectively. The control transmission also simultaneously rotates the curved pipe 30 of the gripper 29 until the vacuum acting at the suction nozzle 31 sucks in and holds fast the thread end of the second thread 13. After a firmly adjusted, brief working-in time, the control transmission rotates the thread take-up device 26 and the gripper 29 into the thread delivery positions shown in FIG. 1.

The thread guide contours of the plates 17 and 18 ensure that the thread 12 coming from the wind-up coil 15 is laid between the gripper member 36 and the gripper member 38 of the thread gripper 32 into the elongated slot 21 of the splicing chamber 20. The thread 13, coming from the supply coil 14, extends over the rear side of the thread take-up device 26, is guided between the gripper member 37 and the gripper member 38 of the thread gripper 33 and likewise laid into the elongated slot 21 of the splicing chamber 20.

The non-illustrated control transmission then sets into motion two likewise non-illustrated cam disks which ensure that the rod 47 and the rod 62 are drawn in direction of the arrow 68 out of the position thereof shown in FIG. 1. During the movement of the rod 47, both regulator elements 44 and 45 of the thread regulator 43 and the swivel arm 60 of the cover 22 swing towards the left-hand side, as viewed in the figures of the drawing. Both severing devices 34 and 35 remain opened. Shortly before reaching the terminal position which, for the thread regulator 43, with respect to the thread delivery at the splicing chamber, is equivalent to the thread delivery position, the cover 22 disposes itself already against the edges of the elongated slot 21 of the splicing chamber 20. The electromagnetic drive 80 then brings the thread gripper 32 into the closed position thereof, whereupon the electromagnetic drive 83 also closes the thread gripper 33. By moving the rod 67 into the direction of the arrow 69, the severing devices 34 and 35 are then actuated by means of the control transmission. An otherwise non-illustrated electric switching mechanism switches-on the blowing air. During the blowing period, which may be assumed to be two seconds, the two thread ends newly formed by shortening the threads are sucked in by the pneumatic devices 49 and 51 and held fast. Since the threads have a Z-twist, in the splicing chamber which is at hand, such an air vortex is produced which loosens the thread twist in the thread length laid in between the splicing chamber and the thread gripper 32 and, on the other hand, reinforces or tightens the thread twist in the thread length laid in between the splicing chamber and the thread gripper 33.

The thread regulator 43 is brought again into the initial or normal position thereof without delay after the splicing operation has been performed, and the cover 22 and the severing mechanisms 34 and 35 are opened, while the cam disks ensure that the rods 47 and 62 are moved back in a direction opposite the direction of the arrow 68, and the rod 67 opposite the direction of the arrow 69. Then, the electromagnetic drive and the opening device 80, respectively, become effective initially, whereby the thread gripper 32 is opened, as shown in FIG. 2. Thread twist then reaches again into the splicing location 88 and into the thread length located above splicing location 88. Then, first, does the opening device 83 also become effective, and the thread gripper 33 is also opened. The instant at which the splicing occurs may be set selectively before or after the instant at which the severing of the thread ends occurs.

The threads joined by splicing by means of compressed air at the end of the aforedescribed operations lie finally in the opened splicing chamber 20. Until this instant of time, the otherwise non-illustrated suction-air dosing or metering valve remains opened.

If the winding station is thereafter set into operation again, the thread springs or jerks out of the device 11 due to the winding tension reintroduced therein. The activity of the device 11 is then ended, and the device 11 can then travel to another location at which it will be used. The thread is again located outside the travel range of the device 11.

As noted hereinbefore, the invention of the instant application is not limited to the illustrated and described embodiment. Other embodiments are possible within the scope of the claims.

As the thread coming from below, in this connection, there is meant, generally, a thread that comes from a thread delivery location, such as a creel bobbin or supply coil, for example, or from a thread producer. The other thread is the thread extending to a thread take-up location, such as the take-up or winding coil or a winding beam, for example. In this regard, the thread travel direction can be upwardly from below as is the case in the illustrated and described embodiment. The travel direction of the thread may, however, also be in opposite direction or actually may have an arbitrary course in space which may be horizontal, for example.

Although the described embodiment is concerned with a travelling device for tying the threads, nevertheless, a device according to the invention may obviously also be located at each individual operating location therefor. The device according to the invention is usable, for example, with spinning machines, creels, tufting machines and the like, besides winding machines.

It has been found to be advantageous to close the splicing chamber by means of a cover during the splicing operation, however, closing of the splicing chamber is not absolutely required. By special construction of the laying-in slot and by special air guidance, splicing will be successful even if the splicing chamber remains open at the side in which the threads are laid in. It is true though that better results are obtained with the device according to the invention when the splicing chamber is closed.

The disposition of the plates, the thread grippers and the severing mechanisms may also deviate from that of the selected embodiments. Thus, it may be better for specific threads to dispose the severing mechanisms as close as possible to the vicinity of the pneumatic devices. The thread grippers could then be disposed near or behind them i.e. quite the reverse of the disposition thereof in the hereinafore-described embodiment. Simultaneously, the upper plate could also be offset behind the upper thread gripper i.e. upwardly.

If threads with an S-twist are to be spliced in the splicing device represented in the figures of the drawing, it is merely necessary first to actuate the selector switch 88 instead of the selector switch 87. The temporal precedence or priority is thereby accorded to the thread gripper 33 holding the thread 13, which must then be considered to be the first thread.

The foregoing is a description corresponding to German Application P 31 32 894.6, dated Aug. 20, 1981, the International priority of which is being claimed for the instant application, and which is hereby made part of this application. Any discrepancies between the foregoing specification and the aforementioned corresponding German application are to be resolved in favor of the latter.

We claim:

1. Device for tying a first thread to a second thread by splicing with pressure gas, the device having a splicing chamber formed with an elongated slot for inserting and tying the threads, at least one pressure-gas channel terminating in an interior space of the splicing chamber, a thread regulator movable from a thread take-up position to thread delivery position for laying the thread into the elongated slot of the splicing chamber, and controllable parts including thread severing devices for separating ends of the threads, a controllable and adjustable pressure-gas dosing device connected to the pressure-gas channel, a device disposed above the splicing chamber for taking up the thread end of the second thread, a device disposed below the splicing chamber for taking up the thread end of the first thread, a controllable thread gripper for the first thread, and a controllable thread gripper for the second thread, comprising an opening device in the thread gripper of the first thread, said opening device having a temporal priority over a second opening device in the thread gripper of the second thread, and the pressure-gas channel terminating eccentrically in the interior space of the splicing chamber for forming a vortex.

2. Device according to claim 1 including a cover for transitorily locking the splicing chamber.

3. Device according to claim 1 including means for covering the elongated slot.

* * * * *